US007806631B2

(12) United States Patent
Smith et al.

(10) Patent No.: US 7,806,631 B2
(45) Date of Patent: Oct. 5, 2010

(54) UNDERGROUND FILLING AND SEALING METHOD

(76) Inventors: Eric W. Smith, P.O. Box 1178, Mars, PA (US) 16046; Homer D. Libengood, 1984 Oaks Point Rd., Blairsville, PA (US) 15717

( * ) Notice: Subject to any disclaimer, the term of this patent is extended or adjusted under 35 U.S.C. 154(b) by 372 days.

(21) Appl. No.: 11/787,629

(22) Filed: Apr. 17, 2007

(65) Prior Publication Data

US 2008/0260473 A1 Oct. 23, 2008

(51) Int. Cl.
*E02D 3/12* (2006.01)

(52) U.S. Cl. ..... 405/267; 405/266; 405/270; 166/292

(58) Field of Classification Search ..... 405/266, 405/267, 269, 270; 166/285, 292, 295
See application file for complete search history.

(56) References Cited

U.S. PATENT DOCUMENTS 1,391,678 A * 9/1921 Francois ..... 405/266
3,949,559 A * 4/1976 Meyer ..... 405/57
4,000,621 A * 1/1977 Maser ..... 405/269
4,058,079 A * 11/1977 Taylor et al. ..... 116/283
4,630,963 A * 12/1986 Wyman ..... 404/75
5,342,149 A * 8/1994 McCabe et al. ..... 405/269
6,747,068 B2 6/2004 Kelly
2005/0081459 A1 * 4/2005 Moroschan ..... 52/169.1

OTHER PUBLICATIONS www.primeresins.com/products/primeflex/ Mar. 6, 2007.
www.avantigrout.com/products/ Mar. 6, 2007.
www.mountaingrout.com/mgflex Mar. 6, 2007.
www.mountaingrout.com/mgslv Mar. 6, 2007.
www.mountaingrout.com/mghl1000 Mar. 6, 2007.
www.mountaingrout.com/mgultra Mar. 6, 2007.

* cited by examiner

*Primary Examiner*—David J Bagnell
*Assistant Examiner*—Sean D Andrish
(74) *Attorney, Agent, or Firm*—Gerald K. White

(57) ABSTRACT

The present invention is directed to a method for filling and sealing underground voids and the like with use of a grout comprising aggregate coated with a water-activated expanded hydrophobic polymeric resin, such as polyurethane.

7 Claims, 1 Drawing Sheet

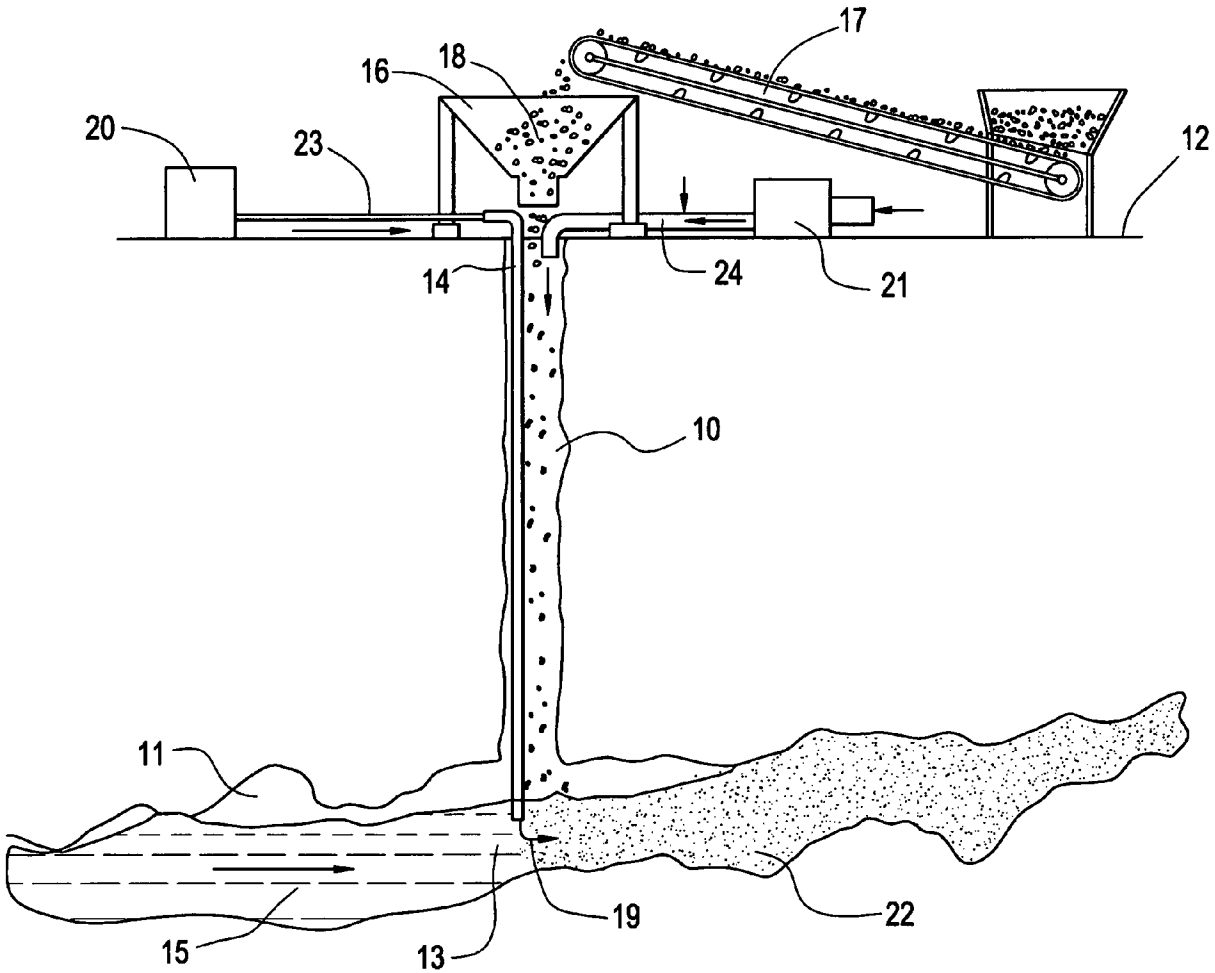
12
17
21
24
10
22
19
18
16
14
13
23
11
15
20

UNDERGROUND FILLING AND SEALING METHOD

FIELD OF INVENTION

The present invention is directed to a method for filling and sealing underground openings, such as holes, voids, pathways, mine shafts, mine passages, cracks, fissures, etc. with use of an underground formed sealing grout comprising aggregate coated with a water activated expanded, hydrophobic polymeric resin, such as polyurethane.

BACKGROUND OF THE INVENTION

The present invention is generally directed to a method of filling and sealing undesired underground openings with use of a grouting material. While the invention is applicable to a number of such underground filling and sealing applications, the filling and sealing of openings in karstic terrain and in mines is of particular interest.

For many years, attempts have been made to close off karstic terrain to prevent undesirable water flow through the terrain. Such water flow causes flooding and/or surface collapse. Karstic terrain is most commonly observed in areas in which predominantly limestone geology has functioned to create underground voids and sink holes at the surface of the ground. Karstic terrain typically contains caves and caverns.

Karst or karstic zones are formed over millions of years when rainfall, which is commonly acidic, flows into cracks and fissures in the ground and contacts limestone bedrock located below the surface of the ground. The contact of acidic rain with the alkaline limestone rock causes two primary actions; namely, (1) corrosion of the rock due to an acid/alkaline reaction; and (2) erosion caused by the abrasive action of water wearing through the rock. The effect of these two actions, over time, creates pathways through the rock thereby forming caves and caverns in a random fashion along with underground water streams. Such created voids and pathways can vary from small cracks to voids of enormous volume. Some of the voids and pathways are located many hundreds of feet below ground but are always connected to the surface due to the method of creation.

Some portions of a given karstic terrain may become filled with clays or fines created by the washout, and thus appear to be normal ground. As time, weather, hydrology, and ground movement occur, the nature of these filled areas often changes abruptly and surface anomalies, such as sink holes, are formed. Often these surface anomalies create problems above ground involving building subsidence and foundation compromise. Underground operations, such as mining, may be impaired or rendered inoperable because of water inundation or the collapse of supporting structures.

The above-mentioned problem exists on a worldwide basis with regions located in many areas including Slovenia, Italy, Ireland, Germany, Israel, Madagascar, China, Japan, Australia, New Zealand, the Caribbean, Canada, and the United States. Many states of the United States, including Florida, New Mexico, Kentucky, Missouri, and Arkansas have karst regions. It has been estimated that about 25% of the United States has karst regions. In recent years, karst formation is believed to have accelerated due, in part, to industrialization and airborne pollutants causing more acutely acidic rain.

Another application for practice of the method of the present invention is that of filling and sealing water-filled portions of underground mines such as coal mines, ore mines, salt mines, etc. Sealing of such portions permits water to be pumped out of such portions, the portions to be repaired, and the subsequent reuse of such portions.

Many attempts have been made to solve the above-mentioned problems with use of traditional grouting methods such as cement grouting, bentonite grouting, bitumen grouting, and various types of chemical grouting. Inevitably, such attempts become abandoned because of the expense of these methods and the unknown extent of the karst region. Although temporary fixes are common, subsequent failure almost invariably occurs. Further attempts to fix the problem are usually not made because of the uncontrollable effectiveness of most of these methods and the associated high costs.

As demonstrated from the above discussion, there is a long standing problem in the art which has not been satisfactorily addressed to date. The present invention is believed to address and solve such long standing problem in the art by providing a novel method of grouting that is both effective in terms of speed of deployment and use of materials and results in the effective filling and sealing of huge volumes of underground voids or openings. As will become apparent from the following description, the method of the invention is believed to provide a quickly deployed, cost effective solution to a substantial problem by creating an underground opening filled and sealed with a grout comprising aggregate coated with an expanded hydrophobic polymeric resin.

SUMMARY OF THE INVENTION

The present invention pertains to a method for filling and sealing an underground opening comprising forming a hole in a portion of the ground, i.e., in an above ground or in ground location, the hole extending through the ground and into an underground region having an open area and containing, moving, and/or induced moving water; inserting a elongated hollow member into the formed hole; feeding particulate aggregate into the hole, and optionally a stream inducing water, whereby the aggregate flows through the hole and enters into allocation in the region where moving water exists; feeding liquid water-activated, expandable, hydrophobic pre-polymeric resin into the elongated hollow member, whereby the resin flows through the elongated member and into the underground region proximate to the location where the aggregate enters the moving water; contacting the aggregate and the resin in the underground region in the presence of moving water through the underground region to form a coated aggregate comprising aggregate coated with an expanded, hydrophobic polymeric resinous coating in the underground region; and then transporting such coated aggregate through movement of the water to an underground opening connected to the open area whereby the coated aggregate fills and seals such opening.

The practice of the present application results in an underground opening filled and sealed with a grout comprising an aggregate coated with an expanded, hydrophobic polymeric resin, such as polyurethane.

BRIEF DESCRIPTION OF THE DRAWINGS

The sole FIGURE is an illustration of a system suitable for use in the practice of the present invention.

DETAILED DESCRIPTION OF THE INVENTION

As evident from previous portions of this application, the method of the present invention relates to filling and sealing underground openings that may contain moving water. Such method generally comprises forming a hole at an above ground or in ground location and extending such hole into an underground region having an open area and containing moving water. Aggregate, and optionally a stream of water, is fed into the hole and passes into the underground region. An elongated hollow member is inserted into the hole to serve as a means to feed a liquid water activated, expandable, pre-polymeric resin into the underground region at a location proximate to the location where the aggregate, or aggregate and water, enter the underground region following passage through the hole. The aggregate and resin are contacted in the presence of moving water causing the resin to form an expanded hydrophobic polymeric coating on the aggregate. Typically, such coating is foamed. The thus coated aggregate or grout is then transported by the moving water to an underground opening connected to the underground region where the coated aggregate settles and fills and seals the underground opening.

As used in the context of the present invention, aggregate may comprise gravel, such as pea gravel; crushed stone or rock; crushed slag; crushed concrete; various minerals; ores; coal; mine or other tailings; asphalt; and similar materials. Aggregate is typically sized from about ⅛ inch to about to 3 inches, with a range of about ⅛ inch to about ¼ inch being typical. However, larger and smaller sizes may be used. The selection of a specific aggregate is primarily based upon the aggregate having sufficient weight to fall out of or settle from the moving water stream prior to being washed out of the underground zone and thereby fail to fill and seal the desired opening. The specific aggregate utilized in a specific process is dependent upon the rate of flow through the zone. A selection criteria is that the aggregate should be able to be pulled away and transported from the mouth of the borehole by the water flow after being coated with a liquid pre-polymeric resin and subsequently for an expanded hydrophobic polymeric coating thereon, and then be capable of settling from the water stream to the base of the zone to react and build a pile of aggregate coated with expanded polyurethane. Because of the large number of variables associated with such settling, trial and error selection is utilized in such determination.

The hole used for feeding aggregate into the underground region from an above ground or underground location may conveniently be formed by boring, drilling, or any other suitable technique. The aggregate may be fed directly into the formed hole or may be fed through a feeding member that extends partially or completely through the length of the hole.

The liquid water-activated, expandable, hydrophobic pre-polymeric resin of the invention is capable of coating aggregate and expanding to create a rigid foam coating following contact with water. Hydrophobic polymeric resins, such as polyurethane, repel water during the reactive phase of polymerization and thus are superior to hydrophilic polymeric resins which entrain water during the reactive phase of polymerization.

Hydrophobic polyurethane resins are well known in the art as grouts used to fill voids and stabilize soils due to their low viscosity, high expansion rate, and ability to set up under wet conditions without diluting. The liquid pre-polymeric resin typically is a one-component system but may be a two-component system. Optional ingredients such as catalysts, reaction accelerators, hydrophobic agents, hydrophobicity inducing surfactants, blowing agents, and other ingredients may be included in the pre-polymeric resins. Low viscosity resins are particularly suitable for use in the invention because such resins are more easily pumped and, due to low viscosity, are more suitable for penetration of the fines in the aggregate. Typical viscosities range from about 100 Centepoise to about 500 Centepoise.

Suitable hydrophobic polymeric resins include, but are not limited to, polyurethane, polyesters, epoxies, and polyureas. Copolymers of polymeric resins are also contemplated as a suitable hydrophobic polymeric resins. Polyurethane hydrophobic resins are preferred due to availability and cost considerations. Moreover, the reactivity profile is easily controlled and a lack of discernable shrinkage occurs following cure.

Hydrophobic polyurethane resins may be made from isocyanate bases such as tolulene diisocyanate and methylene diisocyanate. A methylene diisocyanate (MDI) base is generally considered to constitute a less hazardous material and thus may be preferred for some applications, such as drinking water applications, where water impairment is to be avoided. The hydrophobic polyurethane foam shown in U.S. Pat. No. 6,747,068 would be suitable for use in the present invention. Other suitable hydrophobic polyurethane resins include Prime-Flex 910 and Prime-Flex 920 supplied by Prime Resins, Inc., Conyers, Ga.; AV-248 Flexseal, AV-275 Soilgrout, and AV-280 Hydrofoam supplied by Avanti International, Webster, Tex.; and Flexible, SLV, HL-100, and Ultra supplied by Green Mountain International, LLC, Waynesville, N.C.

The elongated hollow member may be of any desired shape provided the liquid pre-polymeric polyurethane resin may freely pass through such member. A member having a circular cross-section is convenient and is typically used in the practice of the invention.

It will be understood by those skilled in the art that while the following description refers to the sealing of openings in karst zones, such description also applies to the sealing of openings in other underground regions.

The sole FIGURE is an illustration of a system suitable for use in practicing the method of the present invention. When attempting to fill and seal, i.e., to grout underground openings, the procedure is to form hole 10 by drilling from surface 12 down to underground level 13 where karst zone 11 is entered and then to insert elongated hollow member 14 into drilled hole 10. The point of entry is a consideration in that materials to be inserted through hole 10 and elongated hollow member 14 should be placed in contact or in close proximity with induced and/or moving water 15 that is contained in karst zone 11. Hole 10 is typically about 8 inches diameter. Hopper 16 is placed over the mouth of hole 10 and then short, portable intermediate belt conveyor 17 is placed so that its discharge end can direct aggregate material 18 that is fed onto conveyor 17 to be fed, in turn, into hopper 16 thereby permitting the subsequent feeding of material into hole 10.

Elongated hollow member 14 may typically comprise steel or any other type of pipe in sections of around ¾ inch O.D. and ½ inch I.D. Elongated hollow member 14 will be used to inject liquid pre-polymeric hydrophobic resin 19 into karst zone 11. Elongated hollow member 14 is lowered into hole 10 so that its exit end is within or proximate to karst zone 11 and is then secured in place. Pre-polymeric resin pump 20 pumps liquid pre-polymeric hydrophobic resin 19 through liquid resin feed line 23 into elongated hollow member 14.

Karst zone 11 will typically, but not always, contain water 15 moving through zone 11 at varying velocities. In any event, feeding water from high capacity water pump 21 through water feed line 24 into hole 10 may optionally be incorporated in the design of the system so that in the absence of flow in zone 11, water flow can be induced at the surface of water 15.

Of course, pump 21 may also be used in connection with karst zones having water flow to further increase the velocity of such flow.

Once hole 10 has been prepared for feeding material 18 from conveyor 17 and for feeding liquid pre-polymeric hydrophobic resin 19 from elongated hollow member 14 into hole 10, a decision can be made as to the appropriate feed rate from conveyor 17 and the correct pumping rate from pump 20 to match that of conveyor 17. Such decisions are often necessarily made by trial and error because there are a large number of variables involved in such decision. Major variables include: water velocity flow or lack thereof, size and location of opening(s) to be filled and sealed, distance of opening(s) to be filled and sealed from point of entry of materials into zone, size and density of aggregate, nature of pre-polymeric hydrophobic resin, reaction rate of pre-polymeric polymeric resin. An infrared camera and/or flow meter may be used to assist in the determination of suitable feed rates.

Conveyor 17 then feeds a small sized aggregate 18 (typically ⅛ to ¼ inch, but may be smaller or larger) down into the mouth of hole 10 at a regulated rate and aggregate 18 falls, due to gravity, down hole 10 into karst zone. Feed rate may be controlled by an electronic motor control (not shown) that permits variation of conveyor speed.

Once conveyor 17 commences the feeding of aggregate 18, pump 20, which feeds a one or two component, water activated, expandable pre-polymeric hydrophobic resin 19 in the form of a liquid, is turned on so that as aggregate 18 falls down and exits from hole 10 and thus reaches water 15 in karst zone 11, aggregate 18 will contact and become coated with liquid resin 19. Because such coating occurs in the presence of water, resin 19 reacts and creates a light density foamed coating on aggregate 18 thereby forming coated aggregate 22. A catalyst or reaction accelerator may be used to accelerate the reaction of the polyurethane resin, if required.

Thus formed resinous coated aggregate 22 is then swept along with moving water and 15 and thereby transported through karst zone 11 and then gradually, due to its weight, will begin to settle. Settlement creates dams of coated aggregate 22 throughout the karstic system which accumulate and continues to react and thus commences to fill openings connected to karst zone 11 and gradually stops the flow of water 15 through the region by filling and sealing of the openings. Application of aggregate 18 and liquid pre-polymeric hydrophobic resin 19 continues until cessation of water output or the zone becoming filled. Typically, more than a single application may be performed on an as-needed basis, depending on the size of the problem.

The present invention may be further illustrated by the following Example.

EXAMPLE

A large, active limestone quarry is inundated with large amounts (on the order of about 250,000 gallons per minute) of water originating from a nearby river. The water is transmitted through a karstic system located adjacent to a natural fault running from the river through the quarry.

Such inundation has existed for many years; and as the quarry increases in depth (and therefore the hydrostatic head increases also), greater flow of water is created. The associated pumping costs also are increasing.

Various attempts to repair the karst zone are undertaken. Such attempts include conventional grouting with cement, bentonite, and liquid asphalt. However, no discernable improvement is noted. It is decided to attempt filling and sealing the underground openings in the karst zone with use of the method of the present invention.

A grouting method program, such as that described above using about ⅛ inch to about ¼ inch aggregate, and one-component liquid hydrophobic pre-polymeric polyurethane and gravel from the quarry, is designed and implemented. Polyurethane foam coated aggregate is produced upon contact to of the aggregate and liquid polyurethane resin, is then carried by moving water, and desired openings in the karst zone are filled and sealed by the coated aggregate. Water inflow into the quarry is blocked.

A substantial savings in electricity required to pump water from the quarry is realized because of the filling and sealing of the desired openings.

The invention claimed is:

1. A method for filling and sealing an underground opening comprising:

(a) forming a hole, said hole extending through a portion of the ground and into an underground region having an open area and containing moving water;

(b) inserting an elongated hollow member into said formed hole, said elongated member extending into said underground region;

(c) feeding particulate aggregate into said hole whereby said aggregate flows through said hole and enters into a location in said region where moving water exists;

(d) feeding a liquid water activated, expandable, hydrophobic pre-polymeric resin into said elongated hollow member whereby said resin flows through said elongated member and into a location in said region proximate to said location where said aggregate enters said moving water;

(e) contacting said aggregate and said polymeric resin in said underground region in the presence of said moving water to form a coated aggregate comprising aggregate coated with an expanded, hydrophobic polymeric resinous coating in said region; and (f) then transporting said coated aggregate through movement of said water to an underground opening connected to said open area whereby said coated aggregate fills and seals said opening.

2. The method of claim 1, wherein said aggregate comprises gravel.

3. The method of claim 1, wherein said pre-polymeric resin comprises polyurethane.

4. The method of claim 3, wherein said polyurethane is made from a methylene diisocyanate base.

5. The method of claim 1, wherein said underground region comprises a karstic zone.

6. The method of claim 1, wherein said underground region is a mining zone.

7. A method for filling and sealing an underground opening comprising:

(a) forming a hole, said hole extending through a portion of the ground and into an underground region having an open area and containing moving water;

(b) inserting an elongated hollow member into said formed hole, said elongated member extending into said underground region;

(c) feeding particulate aggregate into said hole whereby said aggregate flows through said hole and enters into a location in said region where moving water exists;

(d) feeding a liquid water activated, expandable, hydrophobic pre-polymeric resin into said elongated hollow member whereby said resin flows through said elongated member and into a location in said region proximate to said location where said aggregate enters said moving water;

(e) feeding water into said hole whereby water flows through said hole and into said region thereby increasing flow of said moving water.

(f) contacting said aggregate and said polymeric resin in said underground region in the presence of said moving water to form a coated aggregate comprising aggregate coated with an expanded, hydrophobic polymeric resinous coating in said region; and (g) then transporting said coated aggregate through movement of said water to an underground opening connected to said open area whereby said coated aggregate fills and seals said opening.

* * * * *